US012011633B1

(12) United States Patent
Lewis, Jr. et al.

(10) Patent No.: US 12,011,633 B1
(45) Date of Patent: Jun. 18, 2024

(54) BELT SQUAT ATTACHMENT

(71) Applicants: James Whittier Lewis, Jr., Mountain Brook, AL (US); Kristopher Farley Strickland, Pell City, AL (US)

(72) Inventors: James Whittier Lewis, Jr., Mountain Brook, AL (US); Kristopher Farley Strickland, Pell City, AL (US)

( * ) Notice: Subject to any disclaimer, the term of this patent is extended or adjusted under 35 U.S.C. 154(b) by 0 days.

(21) Appl. No.: 17/714,713

(22) Filed: Apr. 6, 2022

(51) Int. Cl.

| | |
|---|---|
| ***A63B 21/065*** | (2006.01) |
| ***A63B 21/00*** | (2006.01) |
| ***A63B 21/06*** | (2006.01) |
| ***A63B 23/04*** | (2006.01) |

(52) U.S. Cl.
CPC ..... *A63B 21/065* (2013.01); *A63B 21/0615* (2013.01); *A63B 21/151* (2013.01); *A63B 23/0405* (2013.01); *A63B 2023/0411* (2013.01); *A63B 2225/093* (2013.01)

(58) Field of Classification Search
CPC ..... A63B 21/0615; A63B 21/0616; A63B 21/0617; A63B 21/062; A63B 21/065; A63B 21/078; A63B 21/08; A63B 23/0405; A63B 23/0429; A63B 2023/0411; A63B 2023/0447; A63B 2023/0452; A63B 2210/50
See application file for complete search history.

(56) References Cited

U.S. PATENT DOCUMENTS

| | | | | | |
|---|---|---|---|---|---|
| 2,932,509 | A * | 4/1960 | Zinkin | A63B 21/4035 | D21/675 |
| 3,010,720 | A * | 11/1961 | Allard | A63B 21/0615 | 482/145 |
| 4,323,236 | A * | 4/1982 | Szabo | A63B 21/4035 | 482/97 |
| 4,369,966 | A * | 1/1983 | Silberman | A63B 23/03558 | 482/145 |
| 4,813,666 | A * | 3/1989 | Costilow | A63B 21/4047 | 482/80 |
| 5,194,060 | A * | 3/1993 | Marchetti | A63B 23/03525 | 482/133 |
| 5,310,393 | A * | 5/1994 | Highsmith | A63B 21/0615 | 482/148 |
| 5,358,462 | A * | 10/1994 | Calderone | A63B 21/4035 | 482/137 |

(Continued)

*Primary Examiner* — Zachary T Moore
(74) *Attorney, Agent, or Firm* — C. Brandon Browning; Maynard Nexsen PC

(57) ABSTRACT

A belt squat attachment of the present disclosure includes an attachment bar for clipping into holes of a support rack at a height selected by a user. The attachment bar is bisected by and perpendicular to a T-bar, which supports weight horns that are located at the midpoint of the T-bar, allowing a felt load to be calculated as half of the loaded weight. The user clips a belt into the belt ring at the end of the T-bar and performs the belt squat exercise by lifting the attachment and any attached load from a resting position on the ground. The belt squat attachment rotates about the points of attachment between the attachment bar and the support rack during the exercise. Further, the belt squat attachment can be rotated to a storage position against a vertical support behind the support rack while remaining attached to the support rack, allowing the support rack to retain the same utility as prior to attachment of the belt squat attachment.

27 Claims, 10 Drawing Sheets

(56) References Cited

U.S. PATENT DOCUMENTS

| | | | | |
|---|---|---|---|---|
| 8,734,305 | B1 * | 5/2014 | Hoole | A63B 23/1218 482/130 |
| 11,013,945 | B2 * | 5/2021 | Sorin | A63B 21/159 |
| 2018/0311522 | A1 * | 11/2018 | Schmidt | A63B 21/4009 |

* cited by examiner

BELT SQUAT ATTACHMENT

TECHNICAL FIELD

The present invention is directed to a belt squat attachment compatible with multiple pickup heights for performing a belt squat exercise.

BACKGROUND OF INVENTION

Belt squat exercises are performed in a variety of ways, and generally incorporate a belt-supported load that is placed at least partly on the exercise performer's hips and lower body as a standard squat movement is performed. Belt squatting uses a load in addition to the performer's bodyweight, which is attached via a belt around the performer's waist. The exercise is performed as the exerciser bends the legs, which may be bent only slightly or to the extent that the knee joint is closed and the hamstring touches the calf.

Variations to the exercise include use of a bar with or without a "landmine" to fix one end of the bar to the ground, use of a loading pin, use of a "jammer arm" attached to a rack, and use of free standing machines. However, use of a bar with or without a loading pin restricts loading, inhibits the exerciser's range of motion, and typically requires the exerciser to initiate the exercise in a bottom position. A jammer arm also restricts the motion of the exerciser and restricts starting positions, while also being expensive and impacting the utility of any device that it is attached to. Free standing machines allow some flexibility in performing the belt squat, but are expensive and not space-effective, as they require a large amount of exercise space for the performance of one exercise. Many exercisers, including small institutional users, value the flexibility of adaptable exercise systems over single purpose machines. Thus, a cost-effective and flexible adaptation for multi-purpose exercise systems for the performing of belt squats is desirable.

SUMMARY OF THE INVENTION

The present invention is directed to a belt squat attachment and methods of use. In one aspect of the invention, there is provided a belt squat attachment for performing a belt squat exercise. The belt squat attachment includes an attachment bar having at least one attachment hole located at each end of the attachment bar, each attachment hole configured to receive an attachment clip for removably attaching the attachment bar to a support rack. The belt squat attachment further includes a T-bar perpendicular to the attachment bar and coupled to an attachment bar midpoint, the T-bar having two weight horns, a support leg (limiting the bottom position of the T-bar and presenting a safety support to limit the range of motion to the maximum safest range), and a belt attachment means. The two weight horns are coupled to a T-bar midpoint and configured to receive a load, and the support leg is connected to an underside of the T-bar and configured to support the belt squat attachment when it rests on a support surface. The belt attachment means is located at an end of the T-bar opposite the attachment bar and configured to attach a belt to the belt squat attachment. When the user is connected to the belt squat attachment with the belt, and the belt squat attachment is attached to the support rack, the belt squat attachment rotates about an axis formed between each end of the attachment bar as the user performs the belt squat exercise.

In some instances when the belt squat attachment is attached to the support rack, the belt squat attachment is configured to rotate about the axis formed between each end of the attachment bar to a storage position against a vertical support surface. The storage position removes the belt squat attachment from an exercising region of the support rack. In some instances, the attachment clip is configured to be removably attached to two attachment holes (or one per side) of the support rack. The two holes are selected by the user at a desirable exercise height. In some instances, the two weight horns is perpendicular to the T-bar.

In some instances, the support leg rests on the support surface during load addition or removal, or at initiation and completion of the belt squat exercise. In some instances, the support leg is elevated above the support surface by the user during the belt squat exercise. In some instances, the belt attachment means is a ring configured to receive a clip of the belt. In some instances, each attachment hole is configured to receive a pin-locking attachment clip for removably attaching the attachment bar to the support rack. The belt squat attachment may further include a strap attachment means on the T-bar configured to attach a strap to the T-bar for elevating the belt squat attachment above the support surface during load addition or removal or prior to commencement of exercise in a safer and less taxing beginning position.

In another aspect of the disclosure, there is provided a method adapting a support rack with a belt squat attachment for performing a belt squat exercise. The method includes first providing the belt squat attachment and the support rack. The belt squat attachment includes an attachment bar with at least one attachment hole located at each end of the attachment bar, and a T-bar perpendicular to the attachment bar and coupled to an attachment bar midpoint. The T-bar has two weight horns, a support leg, and a belt attachment means, with the two weight horns coupled to a T-bar midpoint. The support leg is connected to an underside of the T-bar at a first end and resting on a support surface at a second end, and the belt attachment means is located on a T-bar end opposite the attachment bar. Each attachment hole of the attachment bar is aligned with one rack attachment hole of the support rack to form at least one aligned hole pair. The attachment bar is attached to the support rack at each aligned hole pair with one attachment clip, where each aligned hole pair receives one attachment clip therethrough. A belt is connected to the belt attachment means so that, when the belt is fastened about a user's waist, the user is capable of performing the belt squat exercise. The belt squat attachment raises above the support surface during the performing.

In some instances, the method further includes the step of adding or removing a desired load on the two weight horns after the attaching of the attachment bar to the support rack. In some instances, the method further includes the step of storing the belt squat attachment after it is attached to the support rack, the storing occurring by rotating the belt squat attachment about an axis formed between each end of the attachment bar such that the belt squat attachment leans against a vertical support. The storage position removes the belt squat attachment from an exercising region of the support rack. In some instances, rack attachment holes for aligning are selected at a desirable exercise height. In some instances, the belt attachment means is a ring.

In yet another aspect of the present disclosure, there is provided a method of performing a belt squat exercise using a belt squat attachment. The method includes providing support rack with an attached belt squat attachment. The belt squat attachment includes an attachment bar with at least one attachment hole located at each end of the attachment bar, and a T-bar perpendicular to the attachment bar and coupled to an attachment bar midpoint. The T-bar has at least one weight horn, a support leg, and a belt attachment means, where the at least one weight horn is coupled to a T-bar midpoint. The support leg is connected to an underside of the T-bar at a first end and resting on a support surface at a second end, and the belt attachment means is located on a T-bar end opposite the attachment bar. Each attachment hole of the attachment bar is aligned with one rack attachment hole of the support rack to form at least one aligned hole pair, and the attachment bar is connected to the support rack at each aligned hole pair with one attachment clip. The method includes connecting a belt to the belt attachment means and wearing the belt. The user then performs the belt squat exercise, so that the belt squat attachment raises above the support surface during the performing.

In some instances, the method further includes the step of adding or removing a desired load on the at least one weight horn prior to connecting the belt to the belt attachment means.

A further understanding of the nature and advantages of the present invention will be realized by reference to the remaining portions of the specification and the drawings.

BRIEF DESCRIPTION OF DRAWINGS

The present disclosure same can be better understood, by way of example only, with reference to the following drawings. The elements of the drawings are not necessarily to scale relative to each other, emphasis instead being placed upon clearly illustrating the principles of the disclosure. Furthermore, like reference numerals designate corresponding parts throughout the several views.

DETAILED DESCRIPTION OF THE INVENTION

The present invention is generally directed to a belt squat attachment and methods of using same. The belt squat attachment is configured to be attached to a support rack or other multipurpose exercise structure, such that multiple exercises can be performed using the same space. The belt squat attachment folds out of the exercising region of a support rack so that it can be stowed while remaining attached. This capability uniquely allows a user to continue to efficiently use the exercise space when the belt squat attachment is not being utilized and provides for easy, safe and timely convertibility in that, for example, a user can be back squatting and decide to belt squat and potentially even go back and forth between the two exercises simply by removing load from the belt squat attachment and folding it up and out of the way. Additionally, the belt squat attachment allows for multiple pickup heights so that any user can easily use the belt squat attachment for belt squat exercises.

Figure 1:
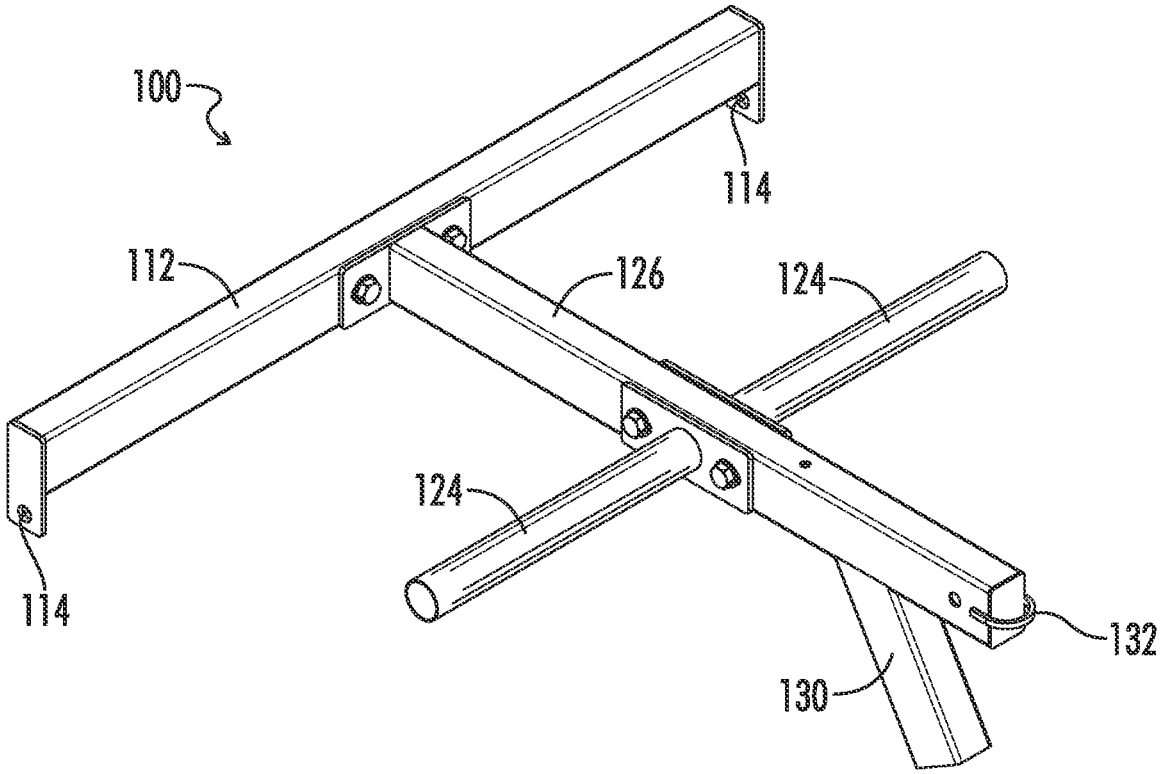
FIG. 1 is a perspective view schematic depicting a first embodiment of the belt squat attachment of the present disclosure unattached to a support rack and without added weights.

FIG. 1 depicts the belt squat attachment 100 of the present disclosure, where it is shown unattached to a support rack 110 or another support structure. Belt squat attachment 100 is made mainly from metal components, such as painted carbon steel, chromium-plated carbon steel, cast iron, aluminum, and stainless steel. However, other metal materials or alloys are compatible with the present disclosure. Regions of belt squat attachment 100 for resting on surfaces optionally include other materials, such as polymers, foam polymers, rubber, plastic, or other cushioning materials. In some instances, belt squat attachment 100 is prepared from components that are attached using fasteners, brackets, welding, or other fastening means.

Belt squat attachment 100 includes an attachment bar 112 for attachment of belt squat attachment 100 to support rack 100. Attachment bar 112 is formed from a metal rod, tubing, pipe, or bar and includes at least one attachment clip hole 114 for attachment to support rack 100 with at least one attachment clip 116. The dimensions of attachment bar 112 are such that it is configured to fit between vertical supports of a standard support rack 100, which are typically about four feet apart. The dimensions of attachment clip holes 114 are such that they accommodate at least one attachment clip 116, which is also sized to fit within rack attachment holes 118 of support rack 110. In some instances, rack attachment holes 118 are ⅝ inch holes with one inch spacing, one inch holes with two inches spacing, one inch holes with three inches spacing, or any other diameter hole and spacing available on commercially available support racks. At least one attachment clip 116 is in some instances commercially available, and in other instances is customized in dimensions to accommodate both rack attachment holes 118 and attachment clip holes 114. Attachment clip 116 is in some instances pinned and locked through each of rack attachment holes 118 and attachment clip holes 114 for attachment of attachment bar 112. However, in other instances, attachment clip 116 is bolted within rack attachment holes 118 and attachment clip holes 114 for attachment. The location of attachment clip holes 114 are shown as one attachment clip hole 114 on each end of attachment bar 112, though other locations and number of attachment clip holes 114 are possible such that attachment bar 112 is configured to be clipped into rack attachment holes 118 of support rack 110. Attachment bar 112 rotates about a pivot point of each attachment clip 116 when attached to support rack 110, allowing a user 120 to perform exercises, load weights or other loads 122, remove weights or other loads 122, and place belt squat attachment 100 into a storage position. In some instances, rotation of belt squat attachment 100 is limited by the shape of ends of attachment bar 112, while in other cases 360 degree rotation is possible. Attachment bar 112 adds stability to belt squat attachment 100, as it is attached at two points to support rack 110. As such, belt squat attachment 100 uniquely resists, precludes or prevents tipping, tilting, or overturning as load 122 is added and removed and weight distribution is at least temporarily uneven. This differs from jammer arm-reliant systems, as these previous systems only have one point of attachment to a rack and risk destabilization as weights are added and removed.

Figure 2:
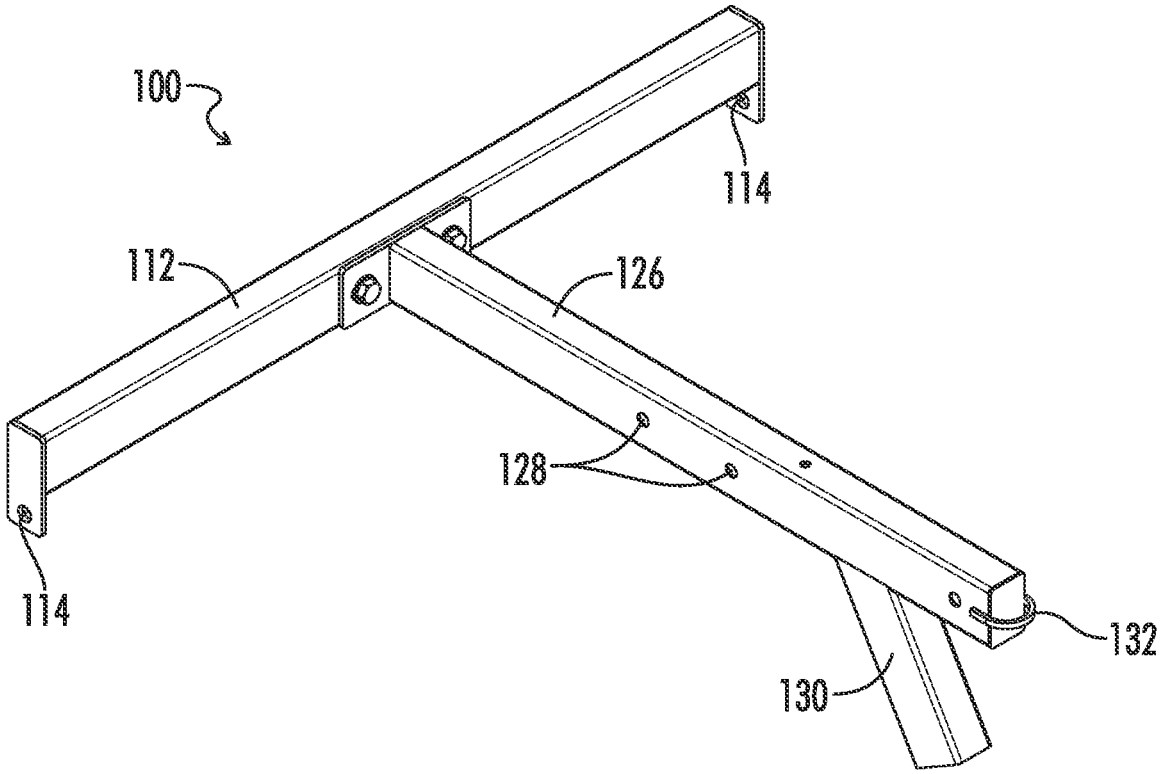
FIG. 2 is a perspective view schematic depicting the belt squat attachment of FIG. 1 without weight horns for mounting weights.

FIG. 1 shows belt squat attachment 100 with at least one weight horn 124 attached to a T-bar 126 for including additional load 122 on belt squat attachment 100. Attachment of weight horns 124 includes fastening of the weight horns 124 to at least one weight horn hole 128 through T-bar 126, as shown in FIG. 2 with weight horns 124 removed. Fasteners are any fastening means known in the art such that fasteners and weight horn holes 128 are compatible. For instance, fasteners include bolts, screws, and other fastening means. Weight horn holes 128 are positioned such that weight horns 124, when attached, are located at a midpoint of T-bar 126. In such a position, it is easy to determine the "felt load", which is half of the weight loaded on weight horns 124. Belt squat attachment 100 differs from other individual components that may be assembled to perform belt squat exercises, in that these individual components are capable of assembly in different configurations that change the fulcrum, and thus impact the felt load. Belt squat attachment 100 is designed for belt squat exercises as one system, and thus has a known weight horn location and method for determining the felt load. Therefore, user 120 can easily determine the amount lifted using belt squat attachment. In embodiments not depicted, weight horn holes 128 are located in different locations about T-bar 126, which change the determination of felt load when weight horns 124 are not located at a midpoint of belt squat attachment.

Referring back to FIG. 1, T-bar 126 is attached to attachment bar 112 at its midpoint, such that loads 122 placed on weight horns 124 on either side of T-bar 126 are evenly distributed. T-bar 126 is attached to attachment bar 112 using fastening means known in the art. In some instances, T-bar has a length of approximately four feet, though other lengths are possible. In some instances, the combined length of two weight horns 124 attached to T-bar 126 is approximately 3 feet, though other combined lengths are possible such that weight horns 124 have equal lengths and are capable of holding loads 122. In some instances, each weight horn 124 is 1.5 feet in length. T-bar 126 approximately bisects attachment bar 112 and is located perpendicular to attachment bar 112. Similarly, weight horns 124 approximately bisect T-bar 126 and are approximately perpendicular to T-bar 126 and parallel to attachment bar 112. However, weight horns 124 are attached to T-bar 126 at different angles in embodiments not depicted.

Belt squat attachment 100 further includes a support leg 130 for supporting belt squat attachment 100 when it rests on a surface, such as the ground. Support leg 130 varies in length depending on application, and is shorter than T-bar 126. Support leg 130 extends below T-bar 126 at an angle from a location between a belt ring 132 at the end of T-bar 126 and weight horn holes 128. In some instances, the location is a midpoint between belt ring 132 and weight horn holes 128, while in other instances the location is closer to or farther from belt ring 132. A cushioning material, such as rubber, plastic, foam, polymer, or other flexible material coats or is attached to the ground-contacting end of support leg 130 in some cases.

At the end of T-bar 126 opposite that attached to attachment bar 112 is located belt ring 132 for attaching a belt 134. Belt ring 132 is in some cases a circular ring that is looped through at least one pair of aligned holes at the end of T-bar 126. In other cases, belt ring 132 is D-shaped, ovular, a rounded triangle, or any other shape capable of looping through holes in T-bar 126 and accepting at attachment component of belt 134. Belt ring 132 is depicted as being at least partially rounded, though in some instances it is not rounded. The size of belt ring 132 is such that it is compatible with the attachment means of belt 134 when inserted in T-bar 126. While a ring is portrayed in the depicted embodiment, belt ring 132 is substituted with another fastening reception means in other embodiments, where other fastening reception means include a clip, hook, a hole, a slot, and a tab. Belt ring 132 is formed from metal, though other materials are possible such that belt ring 132 maintains a connection between belt squat attachment 100, with or without added load 122, and belt 134, when belt squat attachment 100 is in a resting or raised position.

Figure 3:
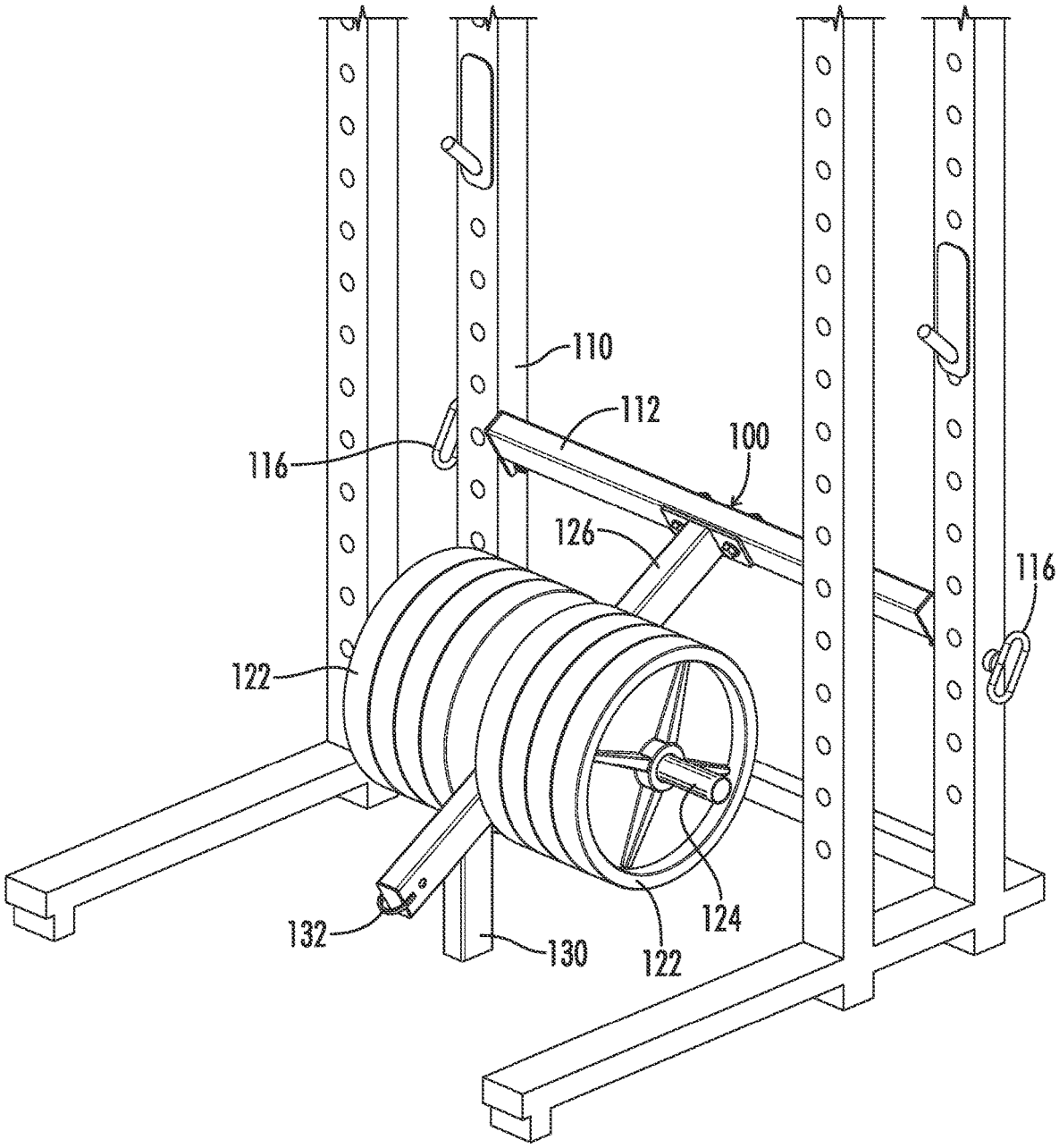
FIG. 3 is a perspective view of the belt squat attachment of FIG. 1 attached to a support rack in a resting position.

In FIG. 3, belt squat attachment 100 is shown attached to support rack 110 in a resting position, with support leg 130 resting on a surface, such as the ground. In the resting position, T-bar 126 is shown sloping downward from attachment bar 112 to belt ring 132. However, the slope is at least partially determined by the height of the points of attachment to support rack 110, where higher points of attachment allow for greater downward slope and lower points of attachment allow for less downward slope. In some cases, no slope occurs when belt squat attachment 100 is attached to support rack 110. In cases where the point of attachment to support rack 110 is lower than the height of support leg 130, T-bar 126 slopes downward from belt ring 132 to attachment bar 112. For ideal weight loading and exercise performance, it is preferable that T-bar 126 slopes downward toward belt ring 132, however. Variations in attachment height are possible based on the desired form of exercise, height of user 120, and size of load 122, among other considerations. Resting position is configured for ease of weight loading for users of various sizes and lifting abilities. For attachment, at least one attachment clip 116 is used to connect attachment bar 112 to rack attachment holes 118 of support rack 110. Rack attachment holes 118 are selected at a height according to the desires of user 120, and rack attachment holes 118 on each vertical portion of support rack 110 are typically selected to be of the same height so that attachment bar 112, when attached, remains parallel to the ground and even. Belt squat attachment 100 is removable from support rack 110 by detachment of attachment clips 116, or may be stored on support rack 110 as described below in detail.

Figure 4:
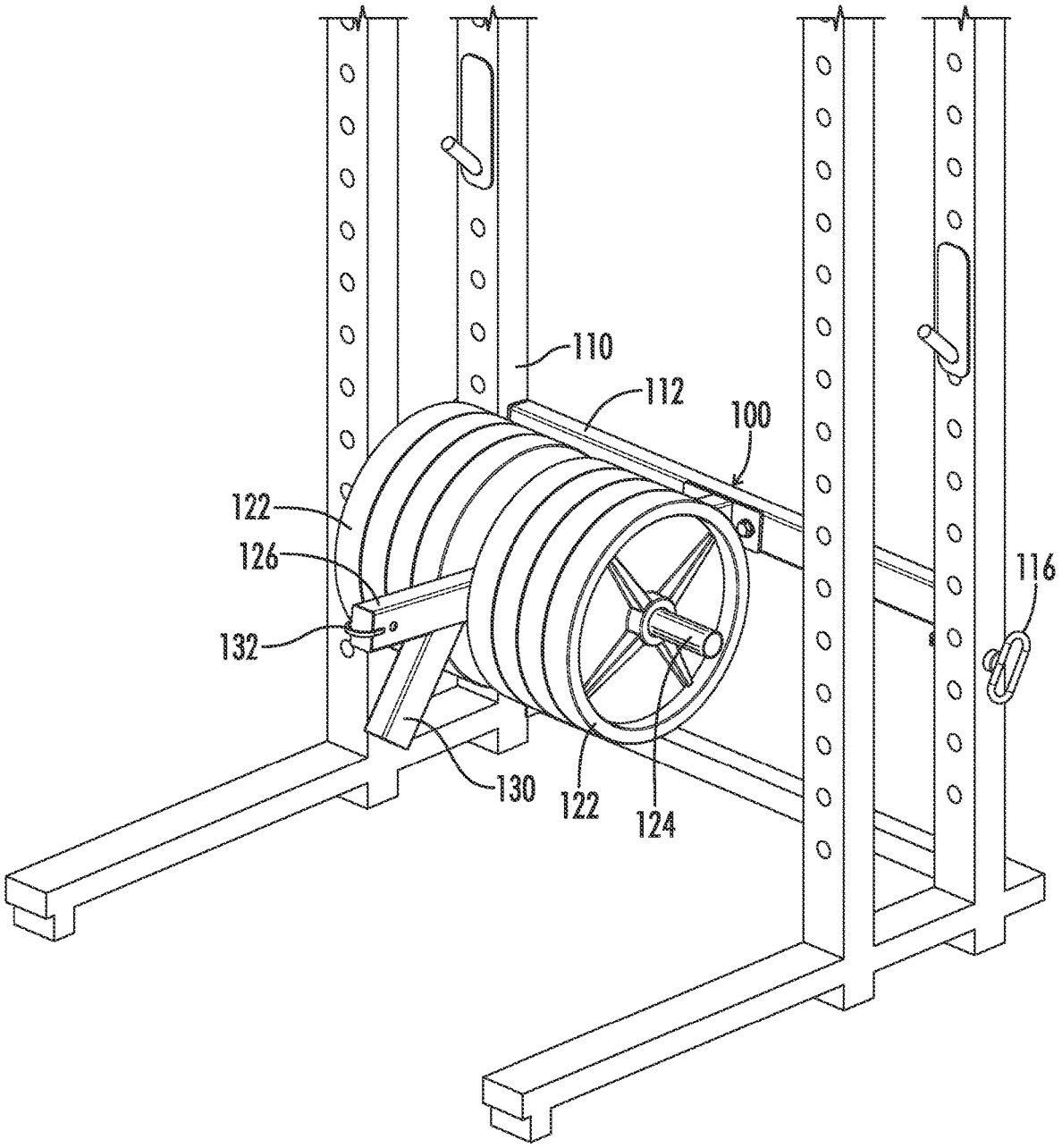
FIG. 4 is a perspective view of the belt squat attachment of FIG. 1 attached to a support rack in a raised position.

In FIG. 4, belt squat attachment 100 is shown attached to support rack 110 in a raised configuration. Load 122 is also added to weight horns 124. Load 122 is depicted as round weights, though other shapes and sizes of weights are possible. Weights for adding load to belt squat attachment 100 are commercially available in a variety of weights and sizes. Weight horns 124 are capable of holding at least one weight to add load, and typically accommodate at least three weights. Weight horns 124 are compatible with commercially available weight clips for securing loaded weights. User 120 or another individual adds load 122 to weight horns 124 when belt squat attachment 100 is in the resting position and performs a belt squat exercise to move belt squat attachment 100 to the raised position. Though no user is shown in FIG. 4, user 130 is capable of lifting belt squat attachment 100 into the position shown in FIG. 4. The upward movement from the resting position requires load 122 and belt squat attachment 100 to be rotated at the points of attachment to support rack 110. Rotation, when unlimited by attachment bar 112, depends on the height of user 120, the exercise performed, the height of the points of attachment of attachment bar 112 to support rack 110, and the strength of user 120. In the raised position, support leg 130 is elevated above the ground.

Figure 5:
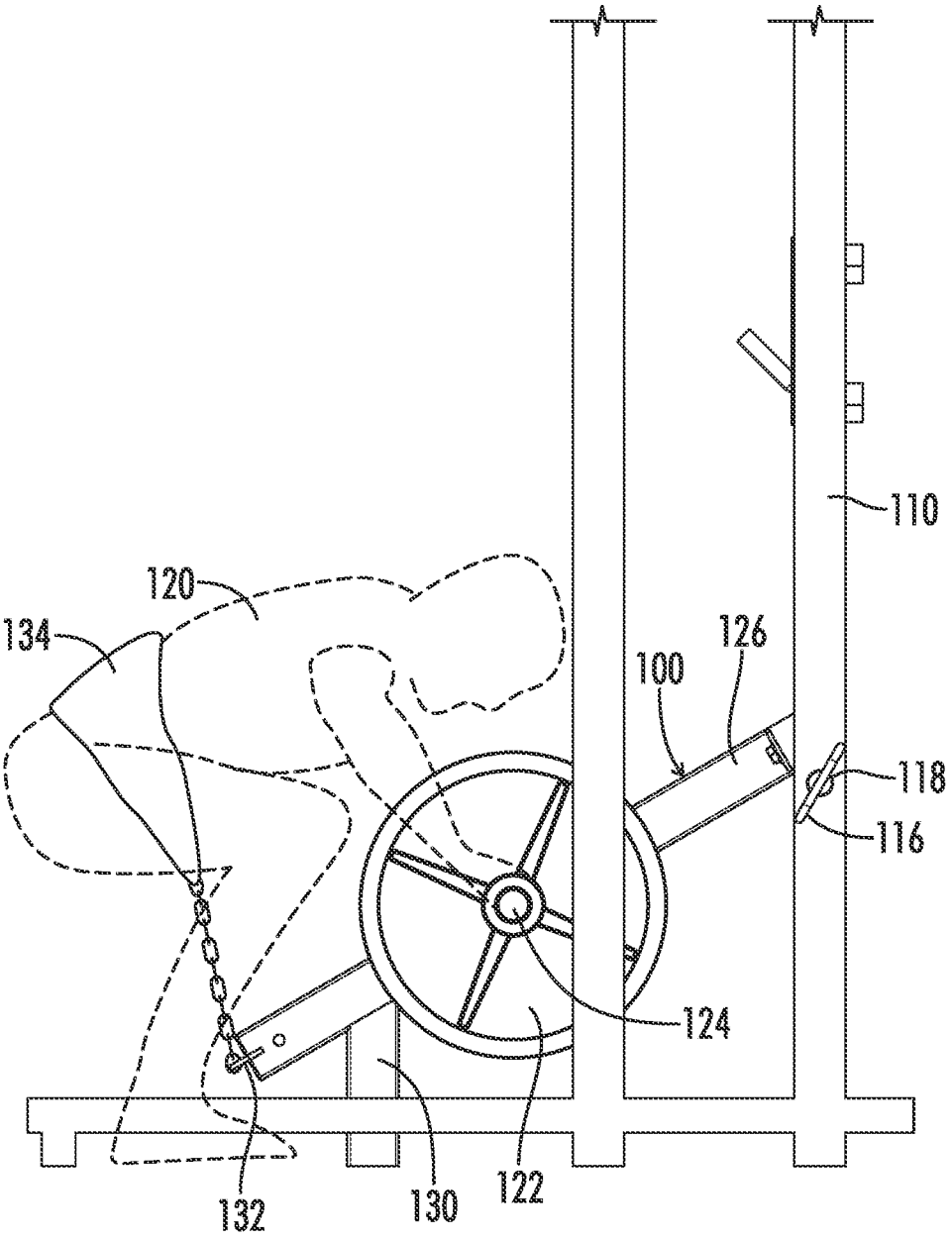
FIG. 5 is a side view of the belt squat attachment of FIG. 1 attached to a support rack and in a resting position, with a user preparing to perform a belt squat exercise.

FIG. 5 shows user 120 using belt squat attachment 100 as it is attached to support rack 110 in a resting position. User 120, depending on height, bends to add or remove load 122 and to attach or remove belt 134 to or from belt ring 132. Belt 143 is in some cases directly attached to belt ring 132, while in other cases it is attached indirectly, as through a connection means such as a chain, strap, clip, or other component capable of attaching belt 134 to belt ring 132 and maintaining such a connection throughout exercise. Belt 134 is a commercially available weightlifting belt, and is typically formed from leather, nylon, or another durable and strong material. User 120 wears belt 134 as directed by the commercial manufacturer or as is known in the art for the performance of weight lifting activities, such as the belt squat exercise. Before beginning the exercise, user 120 optionally adds, removes, or otherwise adjusts load 122 and attaches belt 134 to belt squat attachment 100. User 120 optionally grips belt squat attachment 100, such as at weight horns 124, in performing a belt squat exercise. However, in other cases user 120 does not grip belt squat attachment 100.

Figure 6:
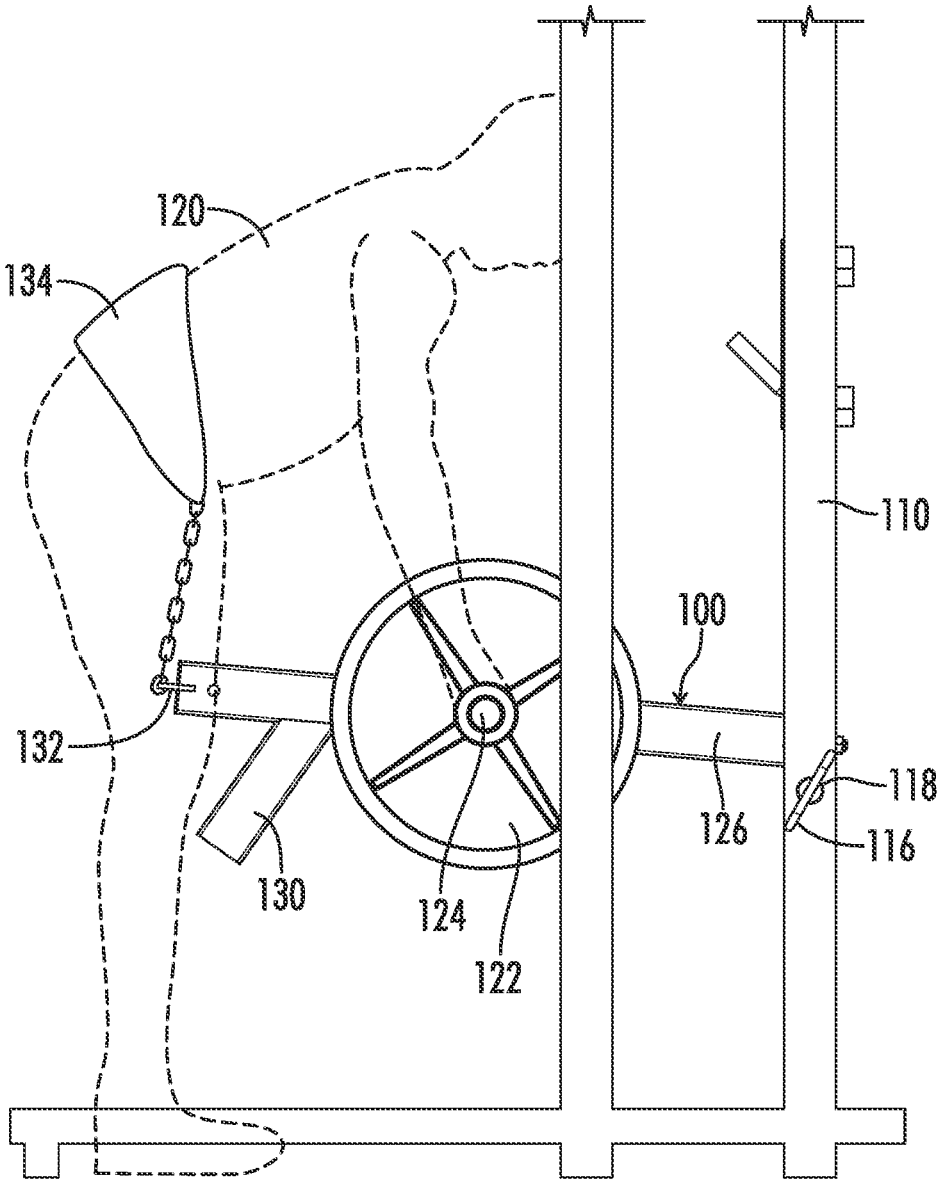
FIG. 6 is a side view of the belt squat attachment of FIG. 1 attached to a support rack and in a raised position, with a user performing a belt squat exercise.

In FIG. 6, user 120 is shown performing a belt squat exercise with belt squat attachment 100 lifted into the raised position. User 120 is clipped to belt squat attachment 100 with belt 134, which is attached specifically to belt ring 132. This attachment allows user 120 to lift belt squat attachment 100 when performing the belt squat exercise. As user 120 straightens legs, belt squat attachment 100 raises from the ground. User 120 additionally lifts with arms gripping belt squat attachment 100, if desired. To end the exercise, user 120 lowers belt squat attachment 100 to the resting position and either unclips or otherwise removes belt 134, detaching user 120 from belt squat attachment.

Figure 7:
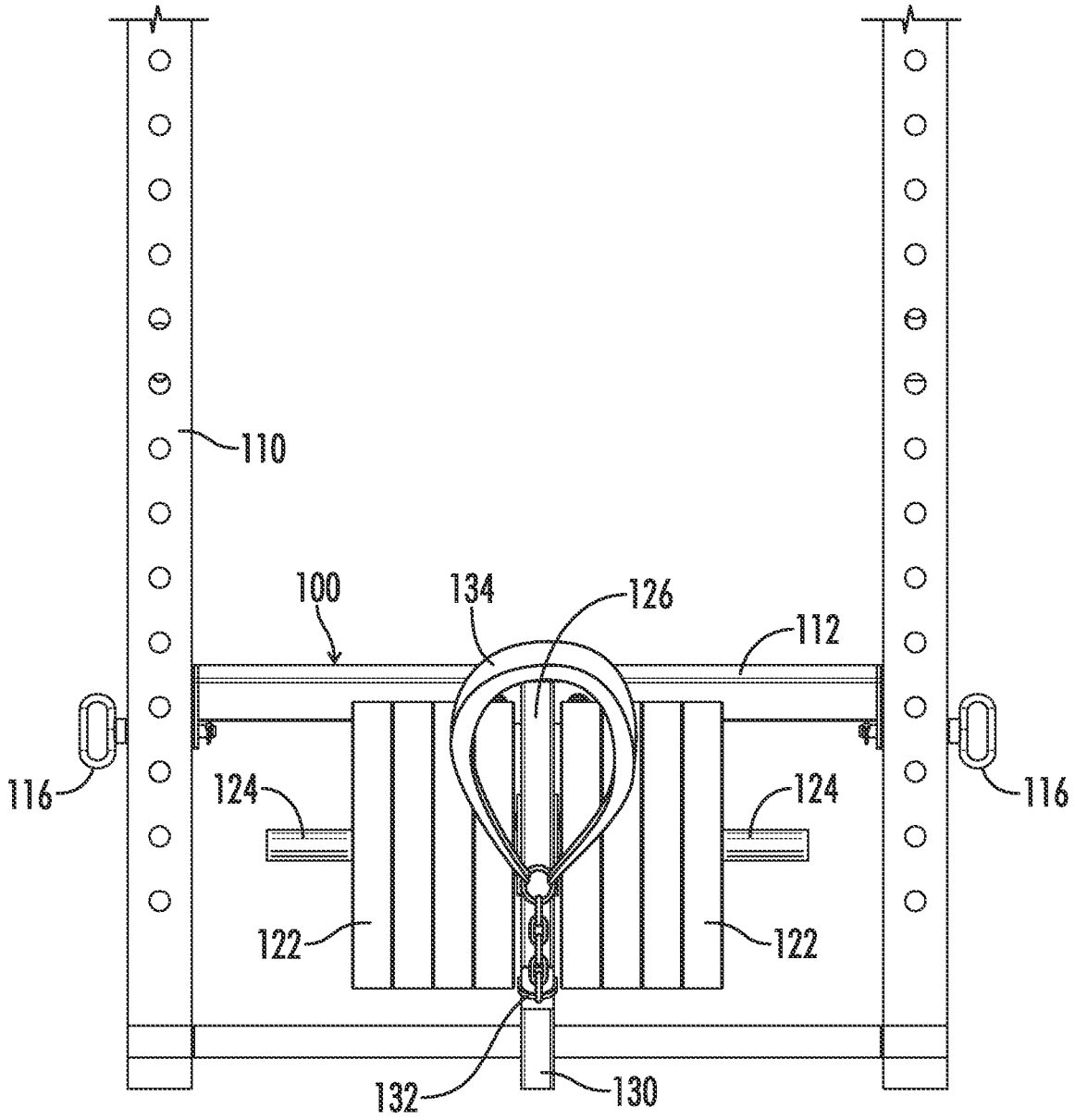
FIG. 7 is a front view of the belt squat attachment of FIG. 1 with a belt clip and the belt squat attachment in a resting position.

In FIG. 7, a front view of belt squat attachment 100 is shown in a resting position. Belt ring 132 is located at a midpoint of the width of belt squat attachment 100, so that weight is configured to be evenly distributed when user 120 lifts belt squat attachment 100. Load 122 is shown to be evenly placed on each of weight horns 124, which is preferred. However, uneven loads are possible. Belt 134 is clipped into belt ring 132, and user 120 attaches belt 134 around the waist for use. In some instances, user 120 wears belt 134 prior to attaching to belt ring 132, while in other cases user 120 attaches belt 134 to belt ring 132 prior to wearing belt 134.

Figure 8:
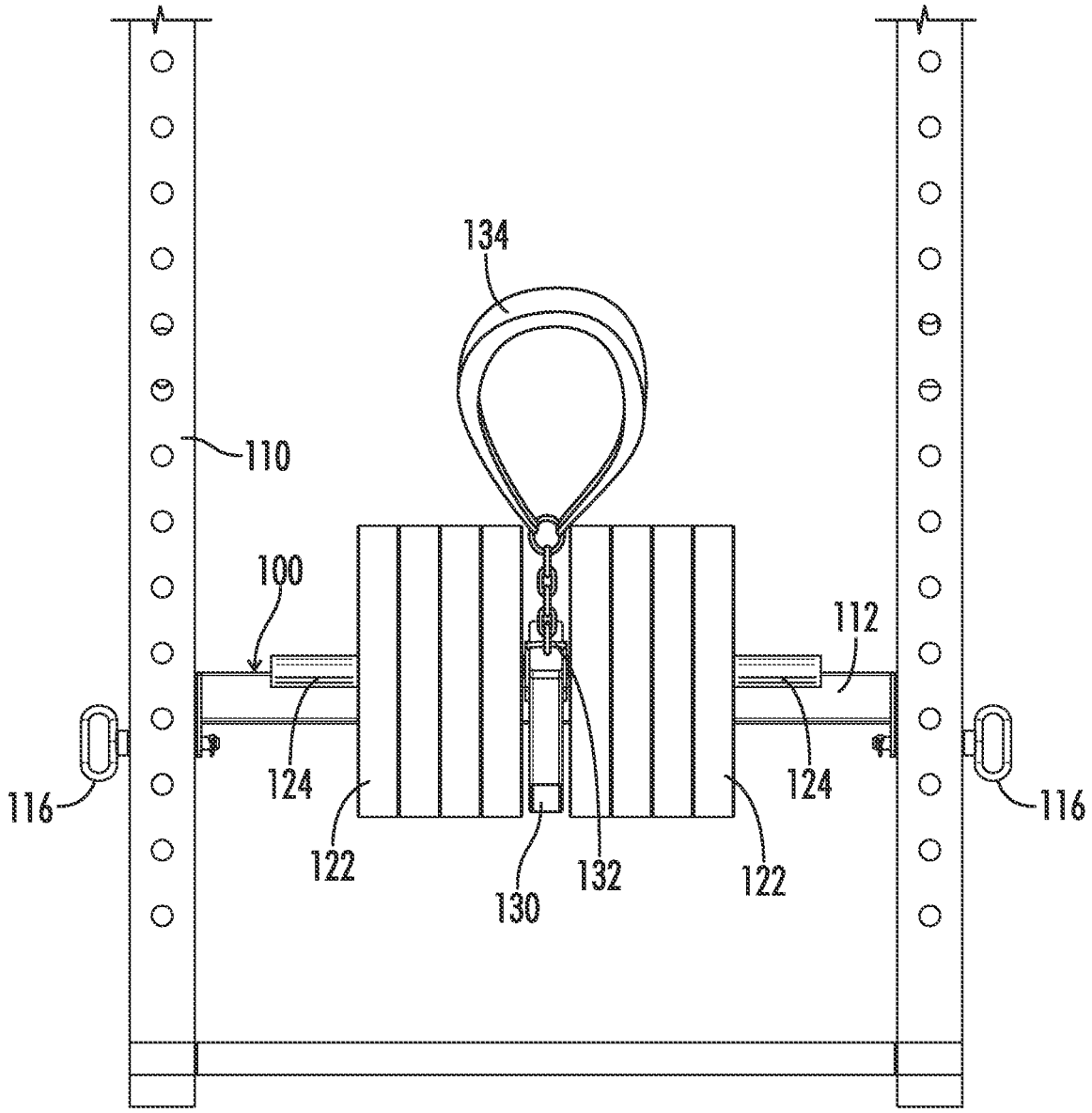
FIG. 8 is a front view of the belt squat attachment of FIG. 1 with a belt clip and the belt squat attachment in a raised position.

In FIG. 8, a front view of belt squat attachment 100 in a raised position is depicted. Belt squat attachment 100 rotates about the pivot points at attachment clips 116, which also serve to lock attachment bar 112 into rack attachment holes 118. Thus, belt squat attachment 100 does not tilt or slide during rotation.

Figure 9:
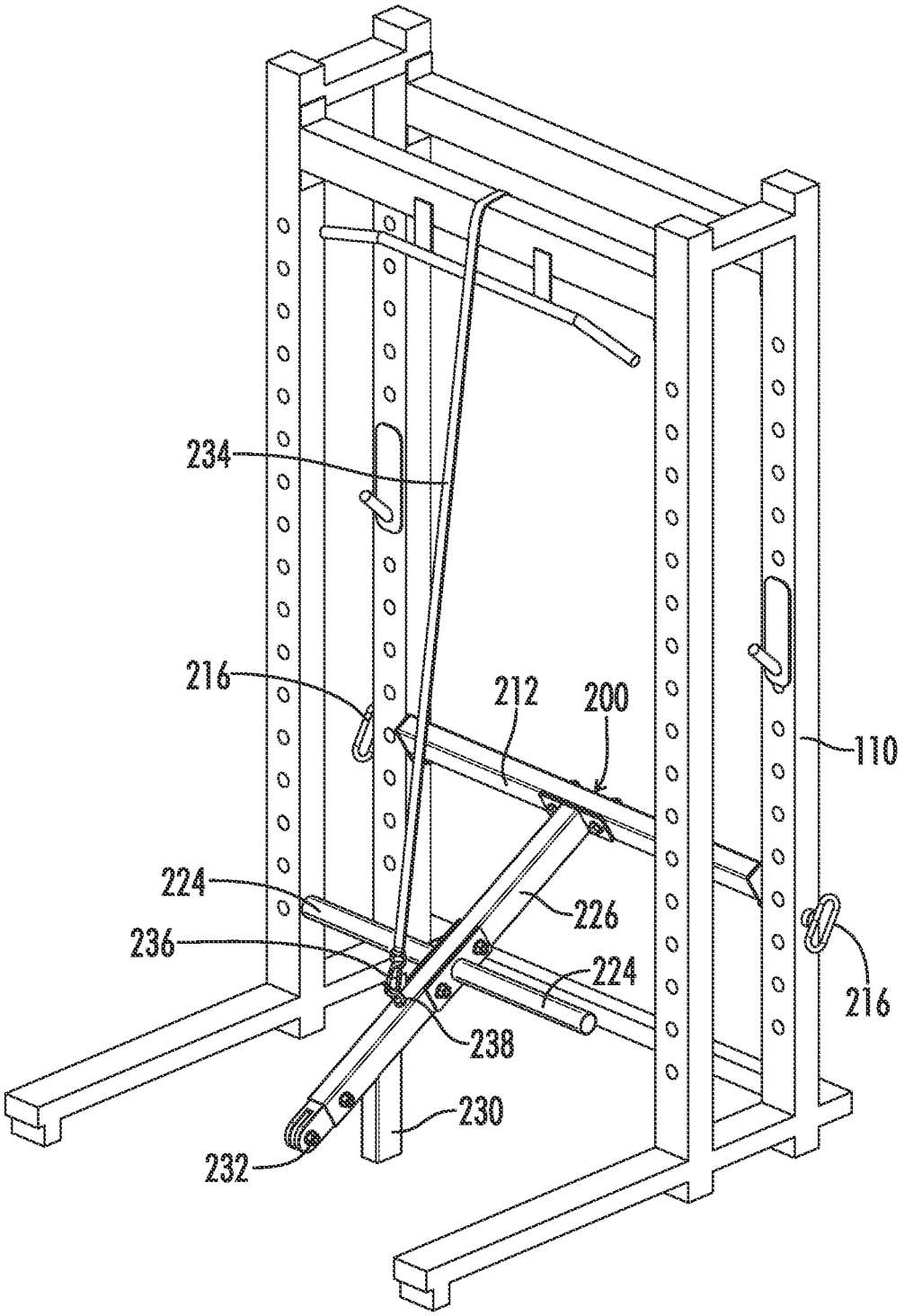
FIG. 9 is a second embodiment of the belt squat attachment of the present disclosure with a strap attached to a mounting ring for elevating the belt squat attachment above the ground for weight loading and unloading.

Referring now to FIG. 9, a second embodiment of the belt squat attachment 200 is shown, where adjustments are made so that belt squat attachment 200 is configured to be at least partially elevated for weight loading and unloading. In this embodiment, support leg 230 is reduced in length by approximately half to allow for elevation by a strap 234, as described below. Attachment bar 212 remains attached to support rack 110 using attachment clips 216 as described above. Additionally, load 122 is configured to be loaded onto weight horns 224, which are positioned on T-bar 226 as described above for the first embodiment of belt squat attachment 100. T-bar 226 includes a strap ring 238 located on an upper surface of T-bar 226 between weight horns 224 and a belt clip receptor 232. In the depicted embodiment, strap ring 238 is closer to weight horns 224 than belt clip receptor 232, though other locations are possible such that strap ring 238 is capable of receiving a strap clip 236 and belt squat attachment 200 is elevated when strap 234 is connected to strap ring 238. The shape of strap ring 238 is in some cases a circular ring, while in other cases it is D-shaped, ovular, a rounded triangle, or any other shape capable of accepting at attachment component of strap 234. Strap ring 238 is depicted as being at least partially rounded, though in some instances it is not rounded. The size of strap ring 238 is such that it is compatible with the attachment means of strap 238. While a ring is portrayed in the depicted embodiment, strap ring 238 is substituted with another fastening reception means in other embodiments, where other fastening reception means include a clip, a hole, a slot, a hook, and a tab. Strap ring 238 is formed from metal, though other materials are possible such that strap ring 238 maintains a connection between belt squat attachment 200, with or without added load 122, and strap 234, when belt squat attachment 200 is in a resting or raised position.

For attachment of strap 234 to strap ring 238 of belt squat attachment 200, strap clip 236 is used. Strap clip 236 is depicted as a clip, though any attachment means compatible with strap ring 238 is possible. Strap clip 236 is attached to strap 234 and configured to attach and detach from strap ring 238. When attached, strap clip 236 connects strap 234 to strap ring 238 such that strap 234 is configured to elevate belt squat attachment 200 above the ground. Strap 234 is formed from any durable material, such as leather or nylon, and is capable of lifting and elevating belt squat attachment 200 and any load 122 placed on weight horns 224. Strap 234 is tied, looped around, or otherwise attached to support rack 110 at the end opposite that connected to strap clip 236. Thus, strap 234 hoists belt squat attachment 200 above the ground from an upper region of support rack 110. The elevation of belt squat attachment 200 is variable depending on the length of strap 234 and the portion of strap 234 between support rack 110 and strap clip 236. For example, use of strap 234 can elevate attachment 200 so that the attachment extends parallel or substantially parallel to the ground or such that a bottom end of leg support 230 or belt clip receptor 232 is between about 1 inch to about 4 feet, between 6 inches to about 3 feet, or about 1 foot to about 2 feet above the ground. In some cases, user 120 adjusts the effective length of strap 234 by altering the point at which strap 234 is attached to support rack 110. Adjustments to strap 234 change the elevation of belt squat attachment 200 so that weights are configured to be added or removed from belt squat attachment 200 comfortably and safely. In addition to weight loading and unloading, a belt squat exercise is also possible from the strap-elevated position. In such a case, user 120 connects belt 134 to belt squat attachment 200 and further elevates belt squat attachment 200 when performing the exercise. Strap 234, strap clip 236 and strap ring 238 allow for loading of attachment 200 while attachment 200 is a safe elevated position which minimizes the initial load on a user. This is akin to removing a bar from the upper uprights prior to performing back squats. After attachment 200 is loaded with the desired weight, strap clip 236 is detached from strap ring 238 so that belt squats of other exercises can be performed. Upon completion of the belt squats or other exercises, strap clip 236 is reattached to strap ring 238.

Another adaptation to belt squat attachment 100 shown in belt squat attachment 200 in FIG. 9 is belt clip receptor 232, which serves the same purpose of belt ring 132 in allowing a connection to belt 134. Belt clip receptor 232 is located at the end of T-bar 226 that is opposite the end attached to attachment bar 212. Belt clip receptor 232 is depicted as at least one aligned hole for reception of a clip, though other receptors are possible, such as a hook, slot, tab, or ring. A clip attached to belt 134 is inserted through and secured about belt clip receptor 232 for attachment of belt 134. For removal, the clip of belt 134 is unfastened and removed from belt clip receptor 232.

Figure 10:
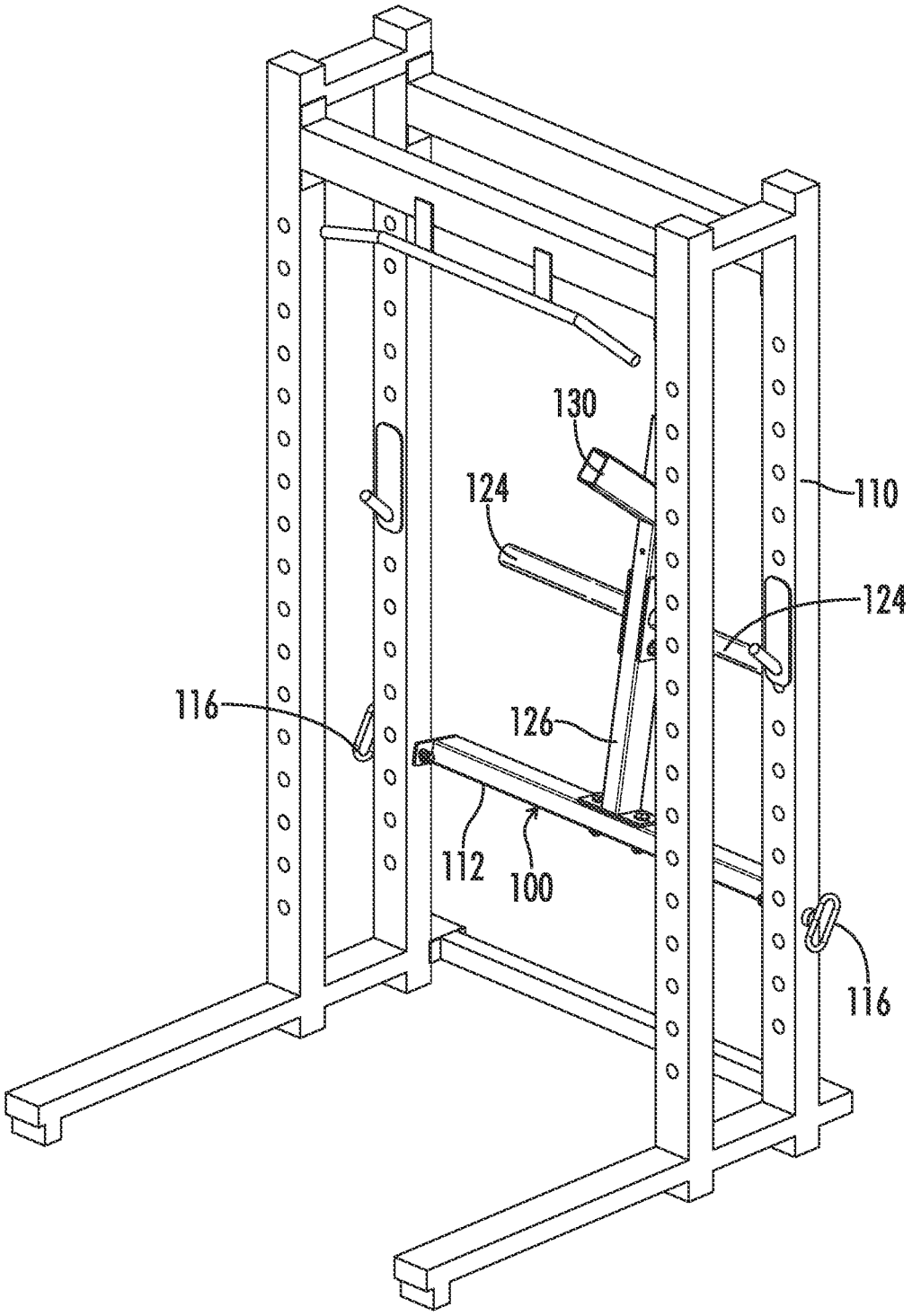
FIG. 10 is a perspective view schematic depicting the belt squat attachment of FIG. 1 in a storage position while attached to a support rack.

Now referring to FIG. 10, belt squat attachment 100 is shown in a stowed position on support rack 110. The storage is advantageous because it saves time for removal and reattachment of belt squat attachment 100. Storage also reduces damage to belt squat attachment 100 that can be incurred during attachment or reattachment or risk to the user from improper reattachment. When belt squat attachment 100 is not needed for performing exercises, it is rotated from the resting position on the ground to a storage position against a vertical structure, such as a wall behind support rack 110. While shown stored without load 122, belt squat attachment 100 is configured to be stored with load 122 when desired. The storage position allows other exercises to be performed in the space within support rack 110 that belt squat attachment 100 previously occupied. Additionally, support rack 110 is available for attachment of other workout attachments while belt squat attachment 100 is still attached, allowing support rack 110 to maintain its utility as a multi-purpose exercise support structure.

As will be understood by those familiar with the art, the present invention may be embodied in other specific forms without departing from the spirit or essential characteristics thereof. Accordingly, the disclosures and descriptions herein are intended to be illustrative, but not limiting, of the scope of the invention which is set forth in the following claims.

We claim:

1. An apparatus for performing an exercise comprising:

an attachment bar having at least one attachment hole located at each end of the attachment bar, each attachment hole configured to receive a respective attachment clip for removably attaching the attachment bar to a support rack; and a bar perpendicular to the attachment bar and coupled to an attachment bar midpoint, the bar having at least one weight horn, a support leg, and a belt attachment means, the at least one weight horn configured to receive a load, the support leg connected to an underside of the bar and configured to support the bar above a support surface, and the belt attachment means located at an end of the bar opposite the attachment bar and configured to attach a belt to the bar, such that when a user is connected to the bar with the belt, and the attachment bar is attached to the support rack, the bar rotates about an axis formed between each end of the attachment bar as the user performs the exercise, wherein the support rack is a multipurpose exercise structure.

2. The apparatus of claim 1, wherein when the attachment bar is attached to the support rack, the bar is configured to rotate about the axis formed between each end of the attachment bar to a storage position against a vertical support surface.

3. The apparatus of claim 2, wherein the storage position removes the bar from an exercising region of the support rack.

4. The apparatus of claim 1, wherein one of the respective attachment clips is configured to be removably attached to at least one rack attachment hole of the support rack.

5. The apparatus of claim 4, wherein the at least one rack attachment hole is selected by the user at a desirable exercise height.

6. The apparatus of claim 1, wherein the at least one weight horn is perpendicular to the bar.

7. The apparatus of claim 1, wherein the support leg rests on the support surface during load addition or removal.

8. The apparatus of claim 1, wherein the support leg rests on the support surface at initiation and completion of the exercise.

9. The apparatus of claim 1, wherein the support leg is elevated above the support surface by the user during the exercise.

10. The apparatus of claim 1, wherein the belt attachment means is a ring configured to receive a clip of the belt.

11. The apparatus of claim 1, wherein each of the attachment clips is a pin-locking attachment clip, wherein each attachment hole is configured to receive the respective pin-locking attachment clip for removably attaching the attachment bar to the support rack.

12. The apparatus of claim 1, further including a strap attachment means on the bar configured to attach a strap to the bar for elevating the bar above the support surface during load addition or removal.

13. The apparatus of claim 1, wherein the multipurpose exercise structure includes a first pair of aligned vertical members including a front first vertical member and a rear first vertical member, a second pair of aligned vertical members including a front second vertical member and a rear second vertical member, and a bar catch pin operatively coupled to each of the rear first vertical member and the rear second vertical member at locations above the attachment bar.

14. The apparatus of claim 13, wherein the attachment bar extends to and between the rear first vertical member and the rear second vertical member.

15. The apparatus of claim 14, wherein none of the bar, the attachment bar, the at least one weight horn, the support leg and the belt attachment means is supported by the front first vertical member.

16. The apparatus of claim 1, wherein the attachment bar has a length extending between the ends thereof and defining a longitudinal axis that extends parallel to the axis about which the bar rotates.

17. The apparatus of claim 1, wherein the attachment bar has a length defining a longitudinal axis that does not intersect the axis about which the attachment bar rotates.

18. The apparatus of claim 1, wherein the multipurpose exercise structure is a power rack.

19. The apparatus of claim 1, including the respective attachment clip received within the respective attachment hole, wherein the attachment clips are spaced apart.

20. A method adapting a support rack with an attachment for performing an exercise, the method comprising the steps of:

providing the attachment and the support rack, wherein the support rack is a multipurpose exercise structure, the attachment having:

an attachment bar with at least one attachment hole located at each end of the attachment bar, and a bar perpendicular to the attachment bar and coupled to an attachment bar midpoint, the bar having at least one weight horn, a belt attachment means, and a support leg connected to an underside of the bar and resting on a support surface;

aligning each attachment hole of the attachment bar with one rack attachment hole of the support rack to form at least one aligned hole pair;

attaching the attachment bar to the support rack at each aligned hole pair a respective attachment clip, wherein each aligned hole pair receives the respective attachment clip therethrough; and connecting a belt to the belt attachment means, such that, when the belt is fastened about a user's waist, the user is capable of performing the exercise, wherein the attachment raises above the support surface during the performing.

21. The method of claim 20, further including the step of adding or removing a desired load on the at least one weight horn after the attaching of the attachment bar to the support rack.

22. The method of claim 20, further including the step of storing the attachment after it is attached to the support rack, the storing occurring by rotating the attachment about an axis formed between each end of the attachment bar such that the attachment leans against a vertical support.

23. The method of claim 22, wherein the storage position removes the attachment from an exercising region of the support rack.

24. The method of claim 20, wherein rack attachment holes for aligning are selected at a desirable exercise height.

25. The method of claim 20, wherein the belt attachment means is a ring.

26. An apparatus for performing an exercise comprising:

an attachment bar extending to and between vertically arranged supports of a support rack; wherein the attachment bar has at least one attachment hole located at each end of the attachment bar, wherein the attachment bar has a length defining a longitudinal axis that does not intersect the axis about which the attachment bar rotates a weight bearing bar arranged at an angle of about 90° to the attachment bar and coupled thereto, the weight bearing bar having at least one weight horn configured for receiving a plurality of weight plates, a support leg configured for supporting the weight bearing bar above a support surface, a belt attachment configured for being coupled to a belt, wherein, when a user is connected to the weight bear bar with the belt, the weight bearing bar rotates about an axis extending between each end of the attachment bar as the user performs the exercise, wherein the support rack is a multipurpose exercise structure.

27. The apparatus of claim 26, including a strap extending to and between the weight bearing bar and the support rack, the strap having a length sufficient to maintain the support leg elevated above and spaced-apart from the support surface.

* * * * *